US006196201B1

(12) United States Patent
Fehlmann et al.

(10) Patent No.: US 6,196,201 B1
(45) Date of Patent: Mar. 6, 2001

(54) PRESSURE VALVE

(75) Inventors: Wolfgang Fehlmann; Ruben-Sebastian Henning; Walter Fuchs; Stephan Jonas, all of Stuttgart (DE); Kiyotaka Ogata, Higoshimatsuyama (JP)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/180,934

(22) PCT Filed: Jan. 12, 1998

(86) PCT No.: PCT/DE98/00084

§ 371 Date: Apr. 30, 1999

§ 102(e) Date: Apr. 30, 1999

(87) PCT Pub. No.: WO98/41755

PCT Pub. Date: Sep. 24, 1998

(30) Foreign Application Priority Data

Mar. 15, 1997 (DE) ..... 197 10 891

(51) Int. Cl.[7] ..... F02M 59/46

(52) U.S. Cl. ..... 123/510; 123/467; 137/493.3

(58) Field of Search ..... 123/506, 510, 123/456, 467; 137/493–493.6, 493.9; 417/296

(56) References Cited

U.S. PATENT DOCUMENTS 4,577,606 * 3/1986 Bohringer et al. ..... 123/506
4,926,902 * 5/1990 Nakamura et al. ..... 137/493.3
5,033,506 * 7/1991 Bofinger et al. ..... 137/516.27
5,293,897 * 3/1994 Warga et al. ..... 137/493.3
5,295,469 * 3/1994 Kariya et al. ..... 123/456
5,365,906 * 11/1994 Deweerdt ..... 123/467
5,839,414 * 11/1998 Klinger et al. ..... 123/467
5,950,669 * 9/1999 Fehlmann et al. ..... 137/493.3

* cited by examiner

*Primary Examiner*—Henry C. Yuen
*Assistant Examiner*—Arnold Castro
(74) *Attorney, Agent, or Firm*—Ronald E. Greigg; Edwin E. Greigg

(57) ABSTRACT

A pressure control valve for installation in a supply line between a pump work chamber of a fuel injection pump and an injection point in the engine to be supplied. A valve body that has a first valve seat and an axial through conduit in which a pressure control valve closing member is guided. The pressure control valve closing member opens toward the injection point counter to the force of a first valve spring and has a sealing face that cooperates with the first valve seat, as well as with an axial through bore in the pressure control valve closing member. The bore can be closed by a back-flow valve that opens in the direction of the pump work chamber and has a second valve spring. For an optimal, unthrottled fuel flow through the pressure control valve, fuel conduits are respectively formed between the radially outer circumference faces of the first and second valve springs and the housing walls that encompass them, through which conduit the fuel flows in an unthrottled fashion.

12 Claims, 4 Drawing Sheets

PRESSURE VALVE

PRIOR ART

The invention is based on a pressure control valve for a fuel system of a vehicle. A pressure control valve of this kind that has been disclosed by the reference DE 42 40 302 is inserted into a supply line between a pump work chamber of a fuel injection pump and an injection point in the internal combustion engine to be supplied by it. The pressure control valve has a valve body that is inserted into a tubular fitting, which constitutes a valve housing, and this valve body has an axial through conduit and constitutes a first valve seat with its end face remote from the pump work chamber. A pressure control valve closing member that opens in the direction of the injection point is guided in the axial through conduit of the valve body and is held with a sealing face against the first valve seat by means of the force of a first valve spring. An axial through bore is disposed in the pressure control valve closing member and can be closed by a back-flow valve that opens in the direction of the pump work chamber. During the operation of the fuel injection pump, the pressure control valve closing member is lifted from the first valve seat counter to the force of the first valve spring by means of a medium under high pressure, which is supplied to the pressure control valve from the pump work chamber by way of the supply line, by means of which the pressure control valve opens in the direction of the injection point. At the end of the high-pressure delivery, the pressure control valve closing member returns to its valve seat. At the same time, an injection valve closes at the injection point, which causes pressure waves to travel back and forth in the volume enclosed between the pressure control valve and the injection valve, which waves are in a position to open the injection valve again. In order to prevent this, the back-flow valve disposed in the pressure control valve closing member now opens, by way of which the pressure level in the supply line can be reduced, even after the closing of the pressure control valve closing member, to a standing pressure which can be adjusted by means of the initial stress of the second valve spring of the back-flow valve.

As a result, however, the known pressure control valve of the constant-pressure valve construction has the disadvantage that the fuel flowing from the pump work chamber in the direction of the injection point and the fuel flowing back must respectively flow through the first or the second valve spring radially inward from the outside. As a result, however, the gap measurement between the individual spring coils of the valve springs changes as a function of the opening stroke of the respective valve member so that an undesirable throttling action occurs when there is flow through the valve springs. This throttle effect, which changes as a function of the opening stroke of the valve members, thereby impairs the through flow behavior of the fuel in the pressure control valve, which can have a negative effect on the course of injection at the injection valve of the injection point.

ADVANTAGES OF THE INVENTION

The pressure control valve according to the invention has the advantage over the prior art that the fuel supplied by the fuel injection pump does not flow radially through the valve springs so that an unthrottled flow through the pressure control valve is assured. As a result, the fuel is advantageously conveyed past the valve springs, radially outside them, wherein a fuel conduit with a large cross section is embodied between the radially outer circumference surfaces of the valve springs and a housing wall encompassing them and the fuel can flow through this fuel conduit in an unthrottled fashion.

As a result, it is particularly advantageous to dispose the pressure control valve closing member and the back-flow valve axially one behind the other, wherein the pressure control valve closing member, with its end face oriented toward the pump work chamber, simultaneously constitutes a second valve seat for the valve member of the back-flow valve. In this connection, the opening stroke movements of the pressure control valve closing member and the valve member of the back-flow valve are advantageously each limited by means of a stop piece, which simultaneously reduces the dead or clearance volume in the pressure control valve. For an unhindered fuel flow, these stop pieces thereby have recesses on their circumference surface on their ends remote from the valve members, which recesses are connected by way of lateral bores or lateral openings to an axial blind bore in the end face remote from the valve member, and which, together with this blind bore, are respectively connected to the supply line. Furthermore, the spring plate of the back-flow valve and the part of the pressure control valve closing member protruding into the valve body have axial recesses, preferably ground sections, which at the same time as permitting a favorable guidance of the components in the valve body, also permit an unthrottled through flow of fuel. As a result, the second stop piece of the back-flow valve can be advantageously press-fitted into the axial through conduit of the valve body, wherein the maximal opening stroke path of the back-flow valve can be adjusted by way of the press-fitting depth. The recesses or ground sections on the stop pieces, on the spring plate of the back-flow valve, and on the pressure control valve closing member can thus have all shapes that permit an unthrottled fuel flow while at the same time permitting a sufficient axial guidance of the components in the valve body or in the valve housing. Alternatively, it is possible to provide the first stop piece of the pressure control valve closing member with an axial through bore which directly connects the injection side part of the supply line to the through bore in the pressure control valve closing member so that the returning fuel also does not have to flow through any valve spring and can flow unhindered onward to the back-flow valve.

Other advantages and advantageous embodiments of the subject of the invention can be inferred from the drawings, the description, and the claims.

BRIEF DESCRIPTION OF THE DRAWINGS

Four exemplary embodiments of the pressure control valve according to the invention are represented in the drawings and will be explained in more detail in the subsequent description.

DESCRIPTION OF THE EXEMPLARY EMBODIMENTS

Figure 1:
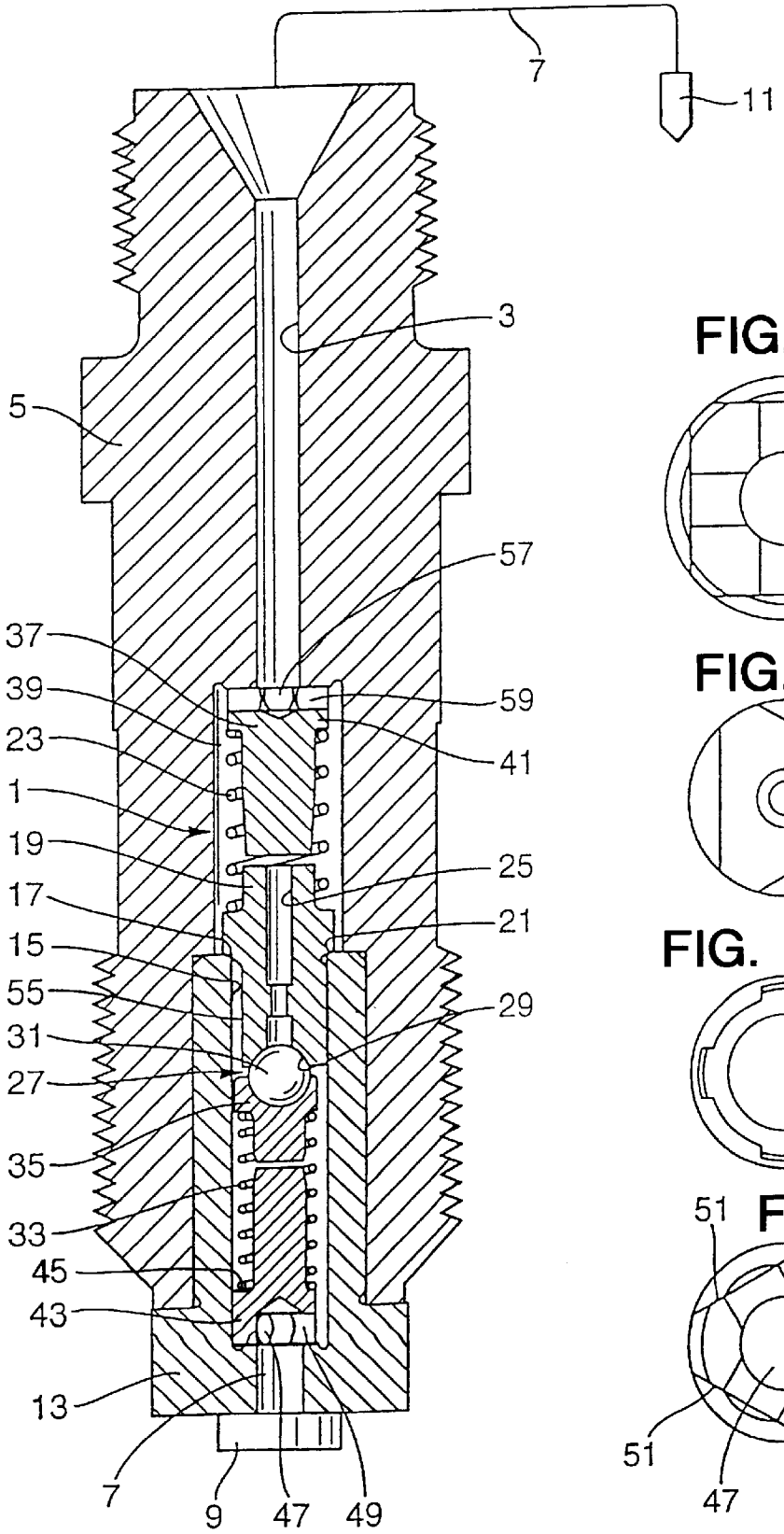
FIG. 1 shows a longitudinal section through a first exemplary embodiment of a pressure control valve embodied as a constant-pressure valve, in which the fuel flow at the second stop piece of the back-flow valve takes place by way of lateral bores.

FIG. 1 shows a longitudinal section through a first exemplary embodiment of the pressure control valve 1 according to the invention, which is inserted into a stepped through bore 3 of a valve housing 5 that constitutes a tubular fitting and for its part, this valve housing is screw threaded into a housing, not shown, of a fuel injection pump. The pressure control valve 1 is thereby inserted into a supply line 7 between a partially depicted pump work chamber 9 of the fuel injection pump and an injection point 11, in the form of an injection valve into the combustion chamber of the engine to be supplied, which is likewise not represented, wherein the through bore 3 in the valve housing 5 constitutes a part of this supply line 7. The pressure control valve 1 has a tubular valve body 13, which is inserted into the through bore 3 of the valve housing 5 on the pump work chamber end. In addition, the valve body 13 has an axial through conduit 15 and, with its annular end face oriented away from the pump work chamber, forms a preferably conically embodied first valve seat face 17. This first valve seat face 17 cooperates with a piston-shaped pressure control valve closing member 19, which is guided so that it can move axially partially in the axial through conduit 15 and has a conical sealing face 21. The pressure control valve closing member 19 is additionally held in contact with the first valve seat 17 by a first valve spring 23 and opens when the fuel pressure exceeds the closing force of the first valve spring 23 in the direction of the injection point 11.

The pressure control valve closing member 19 has an axial through bore 25, which can be closed by a back-flow valve 27 that opens in the direction of the pump work chamber 9. As a result, the annular end face of the pressure control valve closing member 19 oriented toward the pump work chamber 9 constitutes a second valve seat face 29, which cooperates with the valve member of the back-flow valve 27 that is embodied as a ball 31. The valve ball 31 of the back-flow valve 27 is thereby held in contact with the second valve seat 29 by a second valve spring 33 by way of a spring plate 35, wherein the second valve spring 33 is supported in a stationary fashion on the other end against a shoulder of the through conduit 15 in the valve body 13. To limit the opening stroke motions of the pressure control valve closing member 19 and the valve ball 31, two stop pieces are also provided, of which a first stop piece 37 is disposed in a spring chamber 39 of the through bore 3 in the valve housing 5, which chamber is enlarged in cross section and contains the first valve spring 23. On its end remote from the pressure control valve closing member 19, the first stop piece 37 has an annular shoulder 41 against which the first valve spring 23 is supported and thus braces the first stop piece 37 against a bore shoulder in the valve housing 5, which shoulder defines the spring chamber 39. As a result, with its end face oriented toward the pressure control valve closing member 19, the first stop piece 37 constitutes a stop face that limits the stroke motion of the pressure control valve closing member 19, wherein the first valve spring 23 encloses the first stop piece 37.

A second stop piece 43 is inserted into the through conduit 15 of the valve body 13 so that with its end face remote from the valve ball 31, it comes into contact with a bore shoulder of the axial through conduit 15 and with its end face oriented toward the valve ball 31, it constitutes a stop face that cooperates with an associated end face of the spring plate 35. The second valve spring 33 is supported analogously to the first valve spring 23 against an annular shoulder 45 of the second stop piece 43 and thereby radially encompasses the part of the stop piece 43 that has the stop face.

As a result, the valve springs 23 and 33 are disposed so that between their outer circumference jacket faces and the wall of the through bore 3 or the through conduit 15, a fuel conduit is respectively formed, through which fuel can flow in an unthrottled fashion from the pump work chamber 9 in the direction of the injection point 11.

In order to assure an unthrottled fuel flow in the pressure control valve 1 and the back-flow valve 27, the stop pieces 37 and 43 as well as the spring plate 35 and the pressure control valve closing member 19, on its end protruding into the through conduit 15, have the recesses or bores which are shown in the enlarged sectional depictions 1*a*–1*d* and will now be described more precisely one after the other in the flow direction toward the injection point 11.

Figure 1D:
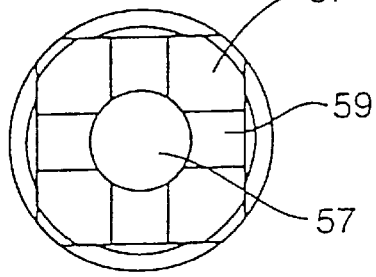
FIGS. 1*a*–1*d* illustrate enlarged sectional depictions of corresponding parts of FIG. 1.
Figure 1C:
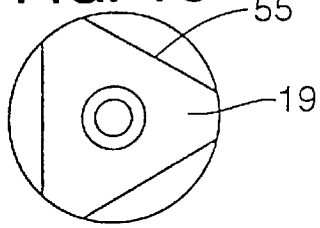
Figure 1B:
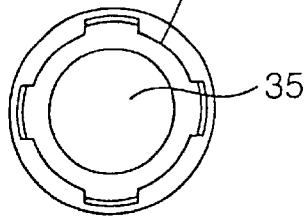
Figure 1A:
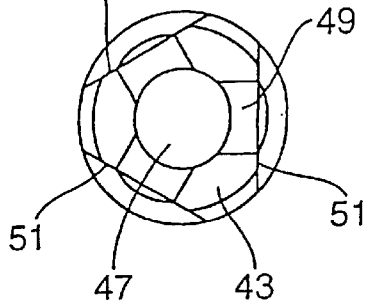

On its lower end face oriented toward the pump work chamber 9 as shown in FIG. 1*a*, the second stop piece 43 has an axial blind bore 47, which feeds into the supply line 7 and is connected to the axial through conduit 15 in the valve body 13 by way of radial lateral conduits 49 (preferably grooves). As a result, in the region of the exit openings of the lateral conduits 49, preferably three ground sections 51 are additionally provided on the second stop piece 43, which assure an unthrottled fuel flow along the second stop piece 43 with a simultaneously reliable guidance of the stop piece 43 in the axial through conduit 15.

The spring plate 35 as shown in FIG. 1*b* likewise has preferably 4 axially extending recesses 53 on its circumference face, which permit an unhindered fuel flow.

On its end adjoining the sealing face 21 and protruding into the through conduit 15 of the valve body 13, the pressure control valve closing member 19 as shown in FIG. 1*c* preferably has three flat ground sections 55, which extend axially to the second valve seat face 29.

Analogous to the second stop piece 43, on its end face oriented toward the injection point 11, the first stop piece 37 as shown in FIG. 1*d* has a blind bore 57 that is coaxial to the through bore 3 and is connected to the spring chamber 39 by way of lateral conduits 59 (preferably grooves). Furthermore, in the region of the annular shoulder 41, the first stop piece 37 preferably has four flat ground sections at the exit openings of the lateral conduits 59, for an unhindered fuel flow.

The pressure control valve according to the invention functions in the following manner. Before the onset of high-pressure delivery of the fuel injection pump, a standing pressure prevails in the supply line 7, at which pressure the pressure control valve 1 and the back-flow valve 27 are held closed by means of the force of the first valve spring 23 and the second valve spring 33. The initial stress of the first valve spring 23 is embodied as greater than the initial stress of the second valve spring 33. With the onset of high-pressure delivery in the fuel injection pump, the pressure in the pump work chamber 9 climbs above the opening pressure of the pressure control valve 1 so that the high fuel pressure prevailing at the first valve seat 17 in the through conduit 15 of the valve body 13 lifts the pressure control valve closing member 19 from the first valve seat 17 counter to the restoring force of the first valve spring 23. As a result, the fuel under high pressure first flows through the second stop piece 43, by way of the openings 47, 49, 51, flows further along the recesses 53 of the spring plate 35 and the pressure control valve closing member 19 into the spring chamber 39 and from there by way of the openings 59, 57 on the first stop piece 37 on into the through bore 3 in the valve housing 5 and from there into the supply line 7 to the injection point 11. There, the high fuel pressure travels to the fuel injection valve in a known manner for injection into the engine to be supplied. As a result, the fuel flow through the pressure control valve 1 and the back-flow valve 27 along the fuel conduits takes place radially outside the valve springs 23, 33 so that the fuel can flow in an unthrottled fashion through the constant-pressure valve to the injection point 11.

After the end of the high-pressure delivery in the pump work chamber 9, the pressure in the supply line 7 drops very rapidly back to below the necessary opening pressure of the pressure control valve 1 so that the first valve spring 23 moves the pressure control valve closing member 19 back into contact with the first valve seat 17 again. The fuel pressure wave produced by the closing of the injection valve 11 and the pressure control valve 1 in the supply line 7 is relieved by way of the back-flow valve 27, for which purpose the fuel pressure prevailing in the through bore 25 in the pressure control valve closing member 19 lifts the ball valve member 31 up from the second valve seat 29 counter to the restoring force of the second valve spring 33. As a result, now the fuel flows out of the supply line 7 by way of the spring chamber 39, by means of the through bore 25 in the pressure control valve closing member 19 into the through conduit 15 in the valve body 13 and by way of the second stop piece 43 back into the pump work chamber 9. After an adjustable standing pressure is reached in the supply line 7, the force of the second valve spring 33 once again exceeds the remaining fuel pressure in the supply line 7 and thus presses the ball valve member 31 back into a sealing contact with the second valve seat 29. The opening stroke movements of the valve members 19 and 31 are thereby limited by means of contact against the stop pieces 37 and 43. Furthermore, the spring initial stress force of the valve springs 23 and 33 can be adjusted by way of the embodiment of the thickness of the annular shoulder against the stop pieces 37 and 43.

Figure 2:
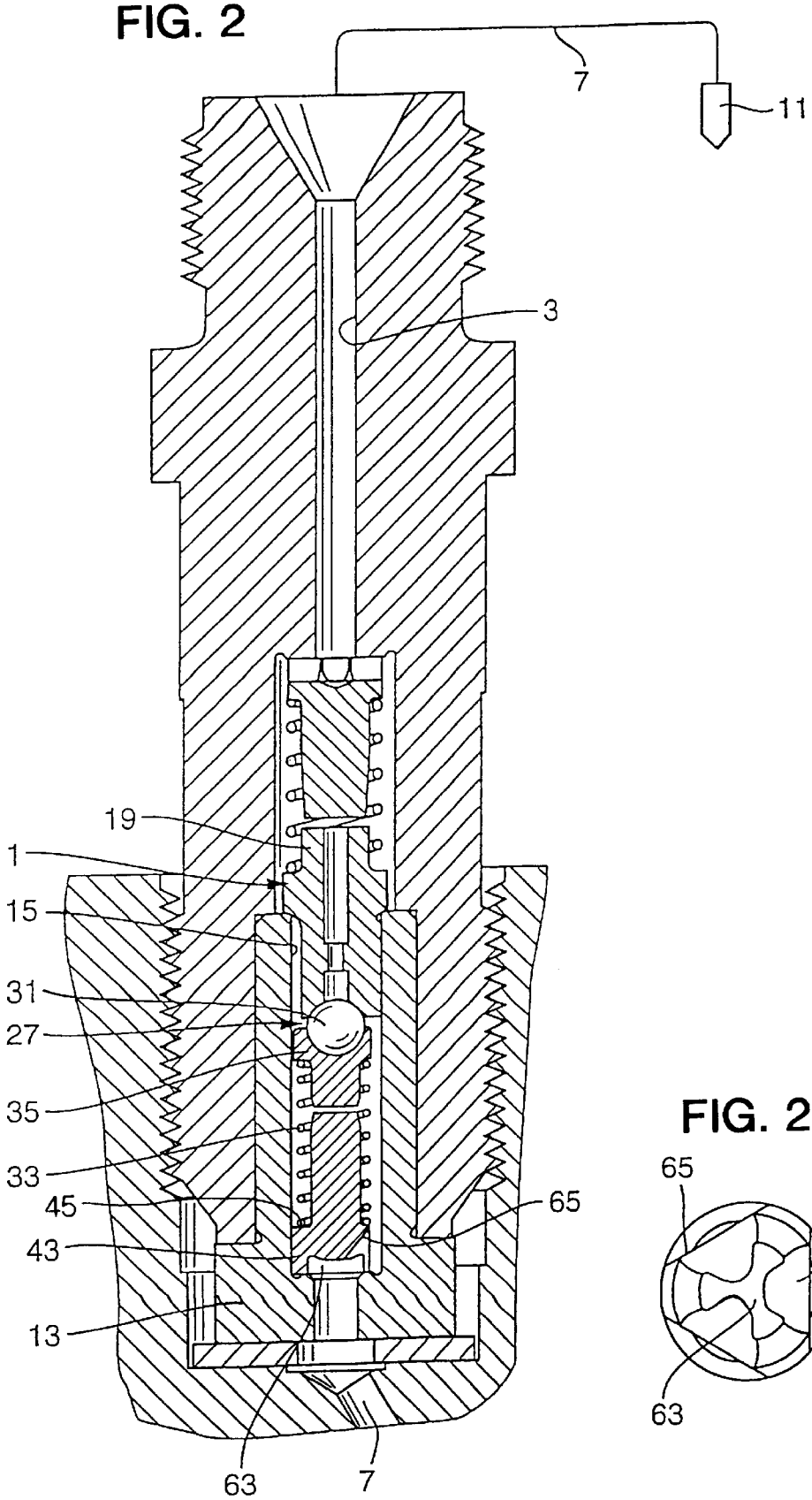
FIG. 2 shows a second exemplary embodiment analogous to the depiction of FIG. 1, in which the fuel flow at the second stop piece of the back-flow valve takes place by way of an oblique ground section.
Figure 2A:
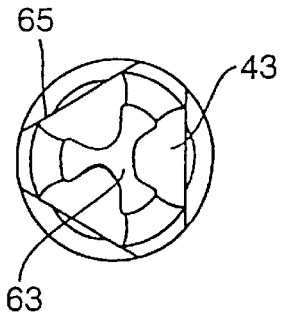
FIG. 2*a* illustrates an enlarged sectional depiction of a second stop piece of FIG. 2.

The second exemplary embodiment of the pressure control valve according to the invention, which is shown in FIG. 2, is differs from the first exemplary embodiment only in the embodiment of the second stop piece 43 of the back-flow valve 27. In lieu of the simple blind bore, the second stop piece 43 has a contour bore 63 that is disposed in its end face remote from the ball valve member 31 and is connected to the axial through conduit 15 in the valve body 13 by way of obliquely embodied flat ground sections 65 on the circumference wall of the cylindrical second stop piece 43. As a result, this fuel flow geometry, which is also represented in a sectional depiction through the second stop piece 43 in FIG. 2, has the advantage that the flow resistance is very low and at the same time, a sufficient support face, which is disposed on the valve body 13 and is for the second valve spring 33, is assured.

Figure 3:
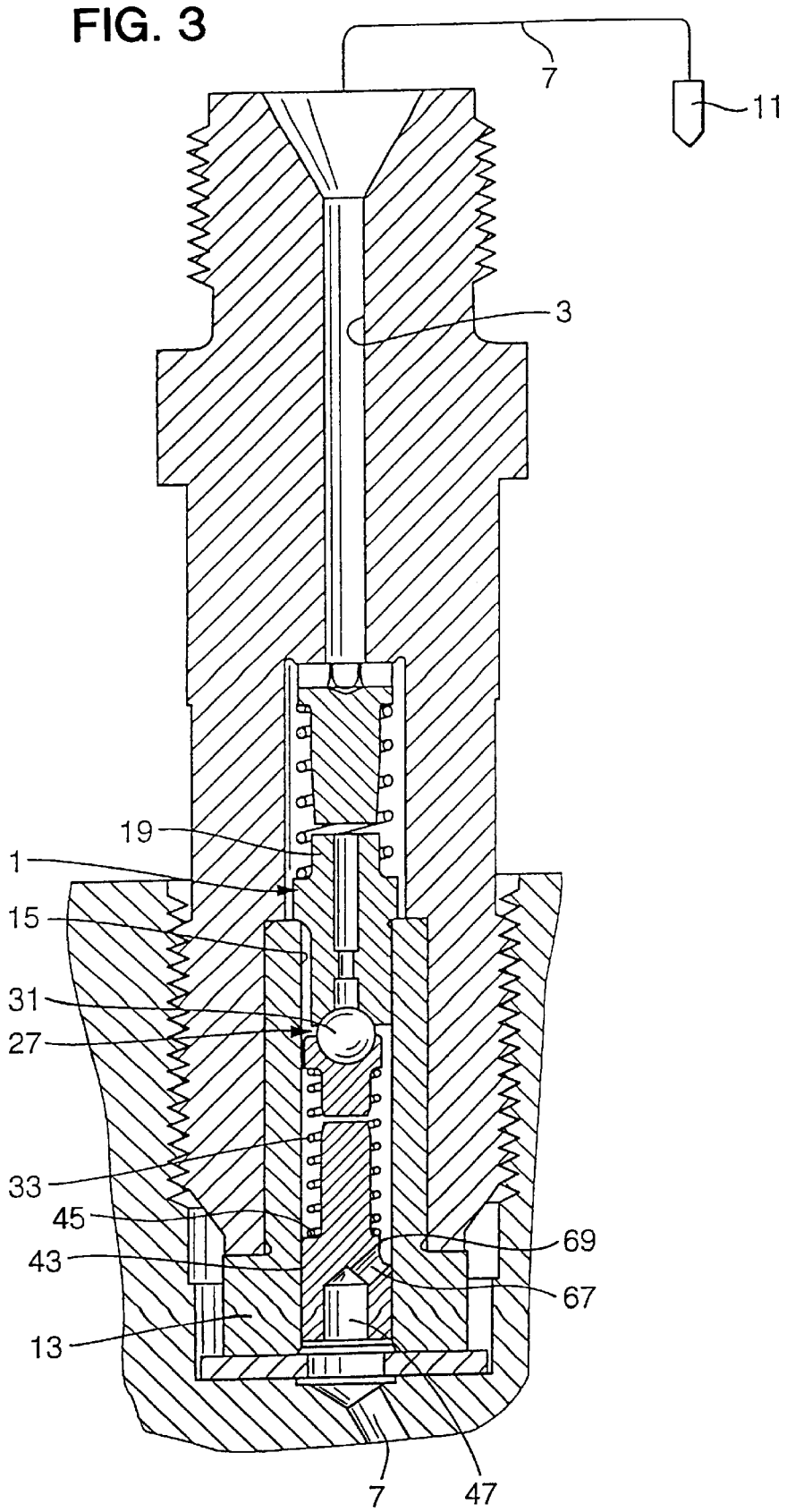
FIG. 3 shows a third exemplary embodiment analogous to the depiction of FIG. 1, in which the fuel flow at the second stop piece takes place by way of an oblique radial bore.

The third exemplary embodiment of the pressure control valve according to the invention, which is shown in FIG. 3, differs from the first exemplary embodiment shown in FIG. 1 only in the embodiment of the second stop piece 43. In FIG. 3, the second stop piece 43, with its cross sectionally enlarged circumference face on its end remote from the ball valve member 31, is press-fitted into the wall of the through conduit 15 in the valve body 13. The fuel flow at the second stop piece 43 now takes place by way of radial oblique bores 67, which lead from axial flat ground sections 69 on the circumference face of the second stop piece 43 and feed into the axial blind bore 47 in the end face of the second stop piece 43 remote from the valve member.

Figure 4:
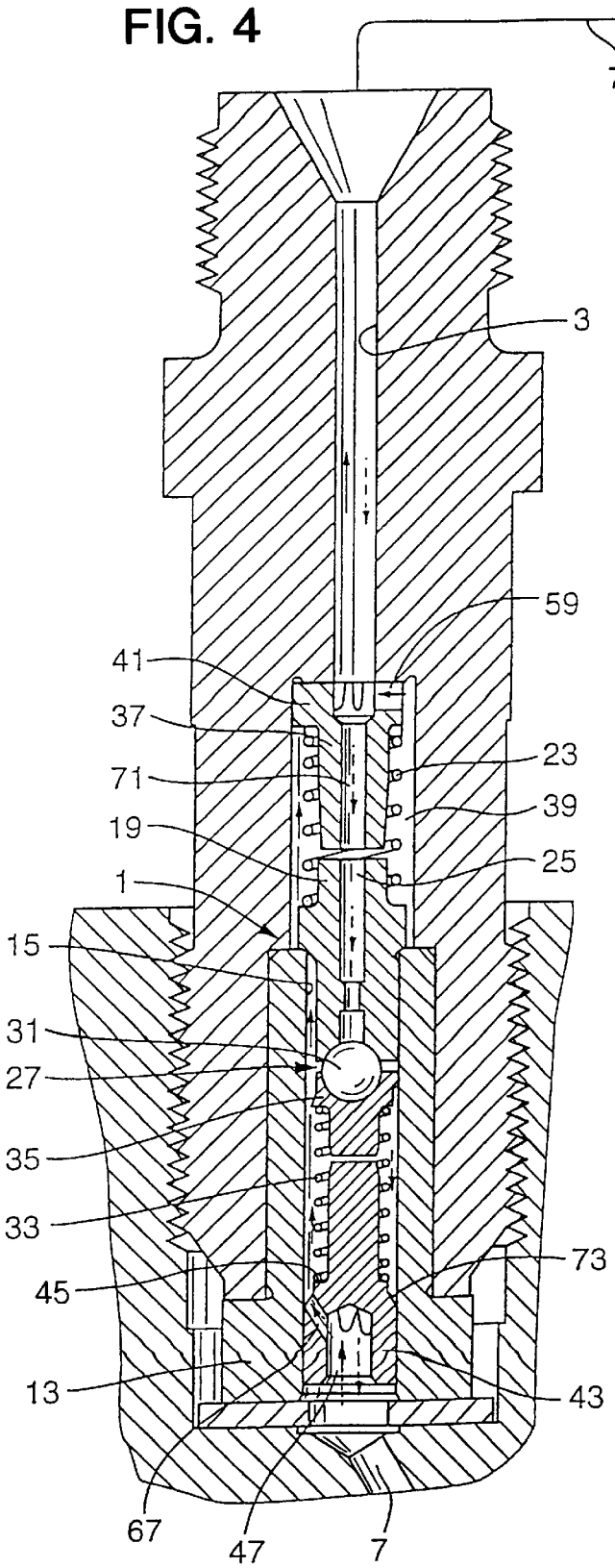
FIG. 4 shows a fourth exemplary embodiment analogous to the depiction of FIG. 1, in which a through bore is provided in the first stop piece of the pressure control valve closing member.
Figure 4D:
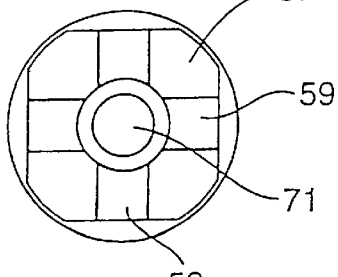
FIGS. 4*a*–4*d* illustrate enlarged sectional depictions of corresponding parts of FIG. 4.
Figure 4C:
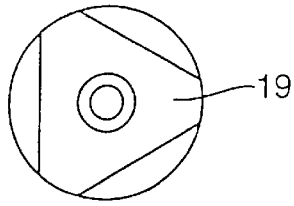
Figure 4B:
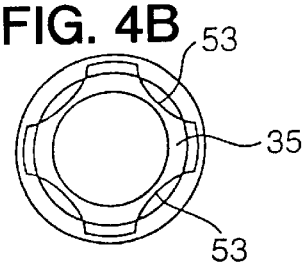
Figure 4A:
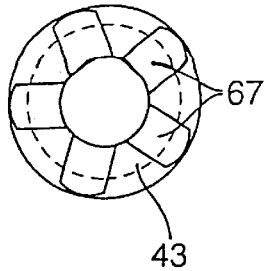

The fourth exemplary embodiment of the pressure control valve according to the invention, which is shown in FIG. 4, differs from the first exemplary embodiment shown in FIG. 1 in the structural embodiment of the first stop piece 37, FIG. 4*d,* of the pressure control valve 1 and of the second stop piece 43, FIG. 4*a,* of the back-flow valve 27. As a result, in lieu of a blind bore, the first stop piece 37 now has an axial through bore 71, from which preferably four lateral conduits 59 lead in a known manner. The lateral conduits 59 lead to the circumference wall of the first stop piece 47 in the region of the annular shoulder 41, and this circumference wall has flat ground sections in this region. As a result, the fuel flow also takes place in the flow direction to the injection point 11, from the spring chamber 39 by way of the lateral conduits 59 and the bore 71 into the through bore 3 and on into the supply line 7. This through flow occurs in particular when the pressure control valve closing member 19, FIG. 4*c,* is resting against the stop piece 37. The fuel flow in the opposite direction from the injection point 11 into the pump work chamber 9, however, now occurs by way of the through bore 71 in the first stop piece 37, from which the fuel can flow onward in an unthrottled fashion into the through bore 25 coaxial to this in the pressure control valve closing member 19 until it reaches the second valve seat 29 against which the ball 31 seats and which is held in place by the spring plate shown in FIG. 4*b*. This embodiment thereby has the advantage that the returning fuel quantity can continue on to the back-flow valve 27 in a very rapid and unthrottled manner and without deflection.

As can also be inferred from the sectional depiction, the second stop piece 43 shown in FIG. 4*a* is now provided with a number of radial oblique bores 67, which feed into an axial blind bore 47. The exit openings of the oblique bores 67 into the through conduit 15 are provided at an oblique shoulder 73 of the second stop piece 43, which once more has an advantageous effect on the flow behavior of the fuel through the second stop piece 43 since the fuel flow is not deflected sharply.

As a result, the fourth exemplary embodiment has the particular advantage that the fuel flow both in the direction toward the injection point 11 and in the opposite direction back into the pump work chamber 9 never has to flow through one of the valve springs 23, 33.

The foregoing relates to a preferred exemplary embodiment of the invention, it being understood that other variants and embodiments thereof are possible within the spirit and scope of the invention, the latter being defined by the appended claims.

What is claimed is:

1. A pressure control valve for installation in a supply line (7) between a pump work chamber (9) of a fuel injection pump and an injection point (11) in the engine to be supplied, comprising a valve body (13) that has a first valve seat (17) and an axial through conduit (15) in which a pressure control valve closing member (19) is guided, said pressure control valve closing member opens toward the injection point (11) counter to a force of a first valve spring (23) and has a sealing face (21) that cooperates with the first valve seat (17), an axial through bore (25) in the pressure control valve closing member (19), said through bore is closed by a back-flow valve (27) that includes a spring plate (35), the back-flow valve opens in a direction of the pump work chamber (9) and has a second valve spring (33), a fuel conduit is formed between the radially outer circumference faces of the first and second valve springs (23, 33), the spring plate (35) and a housing wall that encompasses them and the fuel flows in an unthrottled fashion from the pump work chamber (9) through the control valve in a direction of the injection point (11).

2. The pressure control valve according to claim 1, in which the pressure control valve closing member (19) and the back-flow valve (27) are disposed axially one behind the other.

3. The pressure control valve according to claim 1, in which on its circumference face that adjoins the sealing face (21) and protrudes into the valve body (13), the pressure control valve closing member (19) has at least one axial ground section (55).

4. The pressure control valve according to claim 1, in which the opening stroke path of the pressure control valve closing member (19) is limited by means of a first stop piece (37) that is inserted into a bore (3) of a valve housing (5) and on an end remote from the pressure control valve closing member (19), has an annular shoulder (41) against which the first valve spring (23) is supported and thereby braces the first stop piece (37) against a bore shoulder of the bore (3) in the valve housing (5).

5. The pressure control valve according to claim 4, in which on their ends remote from the valve members (19, 31), the stop pieces (37, 43) have recesses on their circumference face, which are connected by way of connecting conduits to a central recess in the end faces remote from the valve member, which are each fed by a part of the supply line (7).

6. The pressure control valve according to claim 4, in which an axial through bore (71) is provided in the first stop piece (37) and connects the part of the supply line (7) leading to the injection point (1) with a spring chamber (39) that contains the first valve spring (23), and is disposed coaxial to the through bore (25) in the pressure control valve closing member (19).

7. The pressure control valve according to claim 1, in which the back-flow valve (27) is inserted into the axial through conduit (15) of the valve body (13), wherein an end face of the pressure control valve closing member (19) oriented toward the pump work chamber (9) constitutes a second valve seat face (29), which the back-flow valve member (31) is held in contact with by the force of the second valve spring (33).

8. The pressure control valve according to claim 7, in which the back-flow valve member (31) is embodied as a ball, which is guided in a spring plate (35), which with its end face remote from the valve ball (31) constitutes a stop face that cooperates with a second stop piece (43) inserted into the through conduit (15) to limit the opening stroke motion of the valve ball (31).

9. The pressure control valve according to claim 7, in which on their ends remote from the valve members (19, 31), the stop pieces (37, 43) have recesses on their circumference face, which are connected by way of connecting conduits to a central recess in the end faces remote from the valve member, which are each fed by a part of the supply line (7).

10. The pressure control valve according to claim 8, in which axial recesses (53) are provided on the circumference face of the spring plate (35) of the back-flow valve (27).

11. The pressure control valve according to claim 8, in which the second stop piece (43) is press-fitted with a part of its circumference face into the through conduit (15) of the valve body (13).

12. The pressure control valve according to claim 8, in which on their ends remote from the valve members (19, 31), the stop pieces (37, 43) have recesses on their circumference face, which are connected by way of connecting conduits to a central recess in the end faces remote from the valve member, which are each fed by a part of the supply line (7).

* * * * *